US009510667B2

(12) United States Patent
Cho

(10) Patent No.: US 9,510,667 B2
(45) Date of Patent: Dec. 6, 2016

(54) DISPOSABLE TOOTHBRUSH

(71) Applicant: Hyunyil Cho, Orangeburg, NY (US)

(72) Inventor: Hyunyil Cho, Orangeburg, NY (US)

(73) Assignee: THEG, Inc., Bergenfield, NJ (US)

( * ) Notice: Subject to any disclaimer, the term of this patent is extended or adjusted under 35 U.S.C. 154(b) by 0 days.

(21) Appl. No.: 14/281,814

(22) Filed: May 19, 2014

(65) Prior Publication Data

US 2015/0374111 A1 Dec. 31, 2015

Related U.S. Application Data

(63) Continuation-in-part of application No. 12/963,592, filed on Dec. 8, 2010, now Pat. No. 8,726,446.

(30) Foreign Application Priority Data

Aug. 16, 2010 (KR) ..... 10-2010-0078693

(51) Int. Cl.

| | |
|---|---|
| ***A46B 11/00*** | (2006.01) |
| ***A46B 17/04*** | (2006.01) |
| ***A46B 5/00*** | (2006.01) |
| ***A46B 9/02*** | (2006.01) |
| ***A46D 1/00*** | (2006.01) |
| ***A46B 9/04*** | (2006.01) |

(52) U.S. Cl.

CPC ..... *A46B 11/0003* (2013.01); *A46B 5/005* (2013.01); *A46B 9/026* (2013.01); *A46B 9/04* (2013.01); *A46B 17/04* (2013.01); *A46D 1/0207* (2013.01); *A46B 2200/1066* (2013.01)

(58) Field of Classification Search

CPC ..... A46B 11/0003

USPC ..... 401/39

See application file for complete search history.

(56) References Cited

U.S. PATENT DOCUMENTS

| | | | | |
|---|---|---|---|---|
| 4,628,564 | A * | 12/1986 | Youssef | A46B 9/005 15/110 |
| 4,866,809 | A * | 9/1989 | Pelletier | A46B 5/0033 132/308 |
| 6,463,618 | B1 * | 10/2002 | Zimmer | A46B 9/06 15/110 |
| 2002/0175101 | A1 * | 11/2002 | Albert | A46B 11/0003 206/362.2 |
| 2003/0108846 | A1 * | 6/2003 | Hoertsch | A46B 9/005 433/216 |
| 2005/0071939 | A1 * | 4/2005 | Wong | A46B 5/02 15/106 |
| 2006/0195995 | A1 * | 9/2006 | Moskovich | A46B 7/04 15/111 |
| 2008/0104786 | A1 * | 5/2008 | Hohlbein | A46B 9/005 15/167.1 |

* cited by examiner

*Primary Examiner* — David Walczak
*Assistant Examiner* — Joshua Wiljanen
(74) *Attorney, Agent, or Firm* — Hahn & Associates PLLC; Roger C. Hahn

(57) ABSTRACT

A disposable toothbrush is provided having a handle portion, a head portion connected with the handle portion and provided with a plurality of elastomeric bristles on a front surface part of the head portion, a fabric medium attached to the front surface part of the head portion while exposing an upper end of the elastomeric bristles, and an encapsulated bead containing at least one kind of a rapidly releasable agent disposed in a cavity formed in the head portion behind the fabric medium.

18 Claims, 13 Drawing Sheets

DISPOSABLE TOOTHBRUSH

CROSS-REFERENCE

The present invention is a continuation-in-part of U.S. patent application Ser. No. 12/963,592, filed Dec. 8, 2010, the entire contents of which are incorporated herein by reference.

BACKGROUND OF THE INVENTION

Field of the Invention

The present invention relates to a disposable toothbrush, and more particularly to a disposable toothbrush which can be easily carried by a user when he/she is on a business trip or travel, or going out for a meeting, and wherein the toothbrush can be conveniently used any place and freely disposed of after use.

In general, just as it is said that a healthy body can be assured by healthy teeth, having healthy teeth is a barometer of a healthy body. Nonetheless, when people are away from home for a business trip or travel, or are going out for a meeting, most dislike carrying a toothbrush because of the relatively large size, and accordingly often neglect tooth brushing due to the burden of bringing the toothpaste along with the toothbrush.

Meanwhile, as an alternative to carrying a toothbrush and toothpaste when out and about, some people purchase an additional toothbrush and toothpaste from a nearby store or a vending machine on site. This might be an economical burden for the individual, and such a thoughtless consumption further causes a waste of resources to the nation.

There is accordingly a need for an economical, easy-to-carry toothbrush for use away from the home.

Description of the Prior Art

As an exemplary prior art, U.S. Patent Application Publication No. 2009-0320226 discloses an oral care implement, wherein a toothpaste storage part is provided at a head portion, and a film matrix is attached to the head portion. The oral care implement of this prior art reference has drawbacks in that, since the film matrix is simply attached to the head portion in a plane versus plane contact, the contacting area therebetween is too small to provide a strong bonding. There is no separate restraining portion to restrict the film matrix with respect to a direction of tooth brushing, so the film matrix is easily detached from the head portion.

Furthermore, the aforementioned oral care implement has drawbacks in that the film matrix of the head portion is composed of a toothpaste material in a compressed form, which makes it difficult to attach the film matrix to the head portion through the elastomeric bristles. Besides, since the film matrix is in a relatively large form, it is not easily dissolved.

Additionally, the walls of the gel capsule taught in the exemplary prior art are described as frangible, thin walls that easily rupture when rubbed against teeth. This fragility may be undesirable in a portable toothbrush, which could inadvertently be pressed into the inside of the user's pocket or purse, could be jostled against other toiletries in the user's bag, or could be accidentally exposed to moisture such that the gel capsule could burst or dissolve and release the dentifrice contained within the capsule at an inopportune time.

Further still, the aforementioned oral care implement is disadvantageous in that a toothpick part provided at the rear end portion thereof is in the form of which the outer diameter becomes smaller from the inside to the outside, which makes it inconvenient to remove foreign materials deeply clogged between the teeth using the toothpick part. Moreover, the toothpick part as such can abruptly exert an excessive force between the teeth, which can widen the gap between the teeth and lead to high risks of damaging the gums.

Finally, the prior art is disadvantageous in that it does not allow for the controlled release of a toothpaste or bad breath removing cleaning agent. Dentists and Dental Health Associations worldwide agree that a proper tooth brushing session should last at least two minutes. A person usually begins the tooth brushing process by brushing her front teeth, then working her way back to her molars, or she may alternatively begin on one side of her mouth and work her way over to the other side. With toothbrushes such as the one described above, the cleaning agent is released immediately and all at once, and has largely dissipated by the time the user reaches her molars or the teeth on the other side of her mouth. There is therefore a need for a toothbrush that provides for a slower release of the cleaning agent such that more equal amounts of toothpaste or other cleaning agent are distributed to each region of the user's mouth during the two minute tooth brushing session. Likewise, it is advantageous to provide a means for delivering a precise amount of cleaning agent, thereby avoiding the waste caused when a user loads excess toothpaste onto her brush for each use.

SUMMARY OF THE INVENTION

Accordingly, the present invention has been made to solve the above-mentioned problems occurring in the prior art, and an object of the present invention is to provide a disposable toothbrush which is easy to carry and provided with at least one kind of a rapidly releasable agent at a head portion, and wherein the rapidly releasable agent is easily dissolved onto and released from a fabric medium at the time of use, but is resilient to inadvertent release prior to use.

A further object of the present invention is to provide a disposable toothbrush wherein a fabric medium onto which the rapidly releasable agent is absorbed can be easily secured to the head portion.

A still further object of the present invention is to provide a disposable toothbrush which can relatively simply strengthen the bonding force between the fabric medium accommodating the rapidly releasable agent and the head portion in a structural manner.

A further object of the present invention is to provide a disposable toothbrush with an encapsulated store of a rapidly releasable agent such that the agent is released only when the capsule is purposefully ruptured.

A still further object of the present invention is to provide a disposable toothbrush which is able to conveniently remove the foreign materials deeply lodged between the teeth, prevent the gap between the teeth from being widened when removing the foreign materials, and substantially avoid the risks of damaging the gums.

In order to accomplish this object, there is provided a disposable toothbrush, comprising: a handle portion; a head portion connected with the handle portion and provided with a plurality of elastomeric bristles on a front surface part of the head portion; a fabric medium attached to the front surface part of the head portion while exposing an upper end of the elastomeric bristles; and an encapsulated bead containing at least one kind of a rapidly releasable agent disposed in a cavity formed in the head portion behind the fabric medium.

The present invention further provides the following detailed examples with respect to the embodiment of the present invention described in the above. According to a preferred embodiment of the present invention, the fabric medium can comprise a sponge-like cleaning member, wherein the plurality of elastomeric bristles can extend through the sponge-like cleaning member. In one embodiment, the sponge-like cleaning member can comprise multiple rows of irregular cleaning surfaces In an alternative preferred embodiment of the present invention, the fabric medium can comprise a substantially planar surface of fabric through which the plurality of elastomeric bristles extends.

In either preferred embodiment, the encapsulated bead can comprise a crushable gel capsule. Further, the cavity formed in the head portion of the toothbrush can comprise protrusions disposed adjacent to the crushable gel capsule such that the protrusions rupture the crushable gel capsule when the crushable gel capsule is subjected to pressure by the user's teeth.

In any embodiment, the fabric medium can be made of a microfiber material provided with at least one kind of a rapidly releasable agent. Further, the rapidly releasable agent can be attached to a gap between the microfibers of the fabric medium and an outer surface of the fabric medium. In accordance with any embodiment of the present invention, the rapidly releasable agent can be at least one out of toothpaste and a bad breath remover.

Either preferred embodiment of the present invention can further include a plurality of securing protrusions at the periphery of the head portion so as to prevent the fabric medium from derailing outwards in the radial direction of the head portion. According to either preferred embodiment of the present invention, the respective securing protrusions can be composed of a hemisphere-shaped protrusion constituting an upper end portion, and a stem portion integrally connecting the hemisphere-shaped protrusion with the front surface part of the head portion.

In accordance with either preferred embodiment of the present invention, a fabric medium made in a microfiber material with embossing patterns can be further provided on a rear surface part of the head portion. The rear surface part of the head portion can be provided with a plurality of irregular patterns to prevent the fabric medium from derailing outwards.

Meanwhile, the handle portion according to either preferred embodiment of the present invention can further include an inter-dental brush secured to a rear end of the handle portion, and a protective cap detachably coupled to the rear end of the handle portion to protect the inter-dental brush. Here, the protective cap can be made from at least a partially transparent material.

According to any preferred embodiment of the present invention, a knurling part can be further provided on an outer surface of the handle portion to increase the contacting force therewith.

In accordance with any preferred embodiment of the present invention, the elastomeric bristles of the head portion can be formed in a convex pattern such that the elastomeric bristles have a central portion elevated relative to a remaining portion. In accordance with any preferred embodiment of the present invention, the handle portion can be provided with a folding or telescopic structure.

In accordance with an alternate embodiment of the present invention, a disposable toothbrush can be provided, comprising a handle portion, a head portion connected with the handle portion, a fabric medium comprising a sponge-like cleaning member attached to a front surface part of the head portion, and an encapsulate bead containing at least one kind of a rapidly releasable agent disposed in a cavity formed in the head portion behind the fabric medium.

In accordance with an alternate embodiment of the present invention, a disposable toothbrush can be provided, comprises a handle portion, a head portion connected with the handle portion and provided with a plurality of elastomeric bristles on a front surface part of the head portion; and a fabric medium which may be inserted between the plurality of elastomeric bristles, wherein the fabric medium is made of a microfiber material provided with at least one kind of a rapidly releasable agent.

Therefore, it should be appreciated that the disposable toothbrush of the present invention is advantageous in that the rapidly releasable agent can be contained in an encapsulated bead to accommodate the rapidly releasable agent such as the toothpaste, the bad breath remover or the like. Further, in use, the encapsulated bead can be crushed and/or punctured, allowing the rapidly releasable agent to be easily absorbed onto the fabric medium, so that the rapidly releasable agent diffuses in a controlled and even manner from the fabric medium to increase the tooth brushing effects.

In addition, it should be noted here that a plurality of securing protrusions are provided on the front surface part of the head portion to strengthen the bonding force between the fabric medium and the front surface part of the head portion in a structural manner.

Moreover, it should be appreciated that an inter-dental brush is provided at the rear end of the handle portion, so as to conveniently remove the foreign materials deeply clogged between the teeth, prevent the gap between the teeth from being widened when removing the foreign materials, and to substantially avoid the risks of damaging the gums.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, the preferred embodiments of the present invention will be described with reference to the accompanying drawings, FIGS. 1 to 19.

Figure 1:
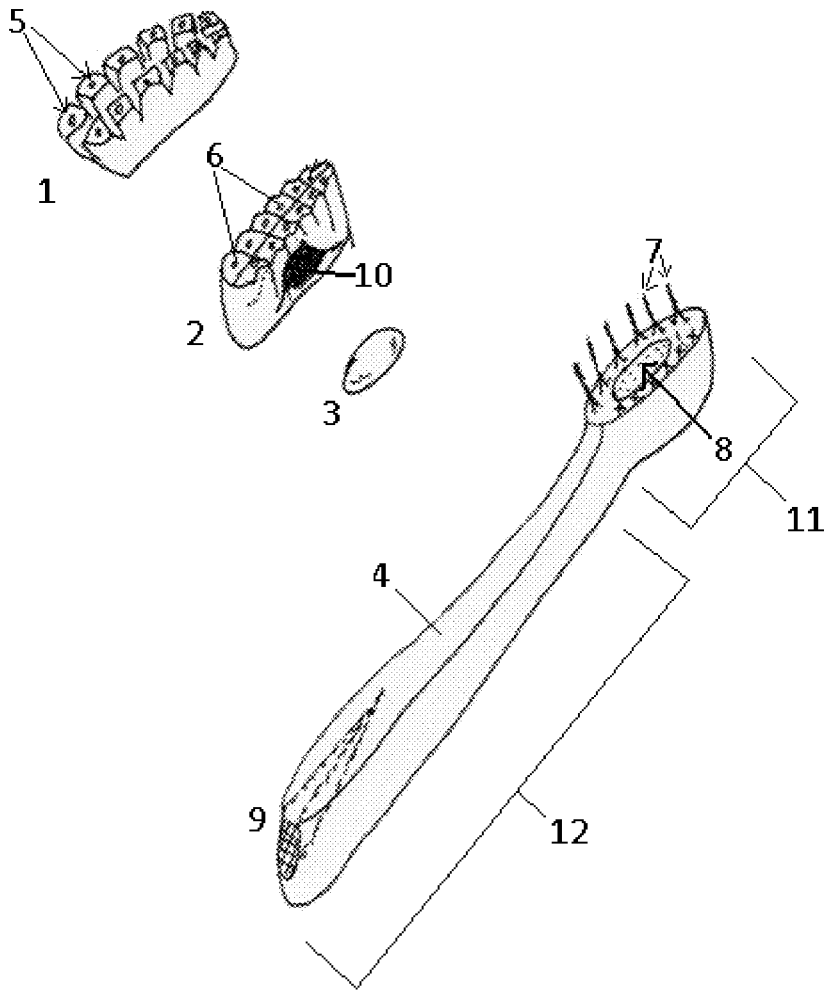
FIG. 1 is an exploded perspective view of a toothbrush having bristles disposed on the front surface part of the toothbrush head, the head further comprising an encapsulated bead disposed in cavity formed in a front surface part of the toothbrush head behind a fabric medium comprising a multi-row sponge-like cleaning member.

FIG. 1 is an exploded view of one embodiment of this invention. In this embodiment, toothbrush 4 includes a handle portion 12, a head portion 11, a fabric medium comprising a sponge-like cleaning member, shown in two parts labeled 1 and 2, and an encapsulated bead 3. The head portion 11 is connected to the handle portion 12 and is provided with a plurality of elastomeric bristles 7. The fabric medium 1 and 2 is made from a sponge-like material and is attached to the front surface part of the head portion 11, while exposing the upper end of the elastomeric bristles 7, which extend through holes 6. The head portion 11 further comprises a cavity 8 formed in the head portion 11 of the toothbrush 4 for receiving an encapsulated bead 3. Cavity 10 formed in the sponge-like cleaning member 2 provides space for capsule 3 when cleaning members 1 and 2 are coupled to head portion 11. Sponge-like cleaning member 1 fits around sponge-like cleaning member 2 so that the plurality of bristles 7 also fit through the holes 5 in the sponge-like cleaning member 1, and such that multiple rows of irregular cleaning surfaces are provided by sponge-like cleaning members 1 and 2. When the encapsulated bead 3 is ruptured, a cleaning agent contained inside the bead 3 can seep through the sponge members 1 and 2 and into the mouth of the user.

In some embodiments, optional detachable toothpick 9 can be included to allow the user to remove particulate matter from in between the user's teeth. In other embodiments, an inter-dental brush (not shown) can be provided on the bottom portion of the handle portion 12 of the toothbrush 4 instead of, or in addition to, the detachable toothpick 9. A protective cap (not shown) may be detachably coupled to the rear end of the handle portion 12 to protect the inter-dental brush. Further, it is desirable that the protective cap is made from a transparent material so as to apparently expose the inter-dental brush provided at the rear end of the handle portion 12. Such constructions may have effects to visually appeal the features of the toothbrush to the consumer in a natural manner. Meanwhile, the handle portion 12 and the inter-dental brush (not shown) may be simply manufactured with insert molding techniques. The inter-dental brush structure allows the user to easily remove the foreign materials that may become clogged in the gap formed between the teeth.

The encapsulated bead 3 can comprise a crushable gel capsule containing a rapidly releasable agent, such than when the capsule is crushed between the user's teeth, the rapidly releasable agent releases into the fabric medium 1 and 2 and plurality of bristles 7, and can be used to clean the user's teeth or freshen the user's breath.

Figure 2:
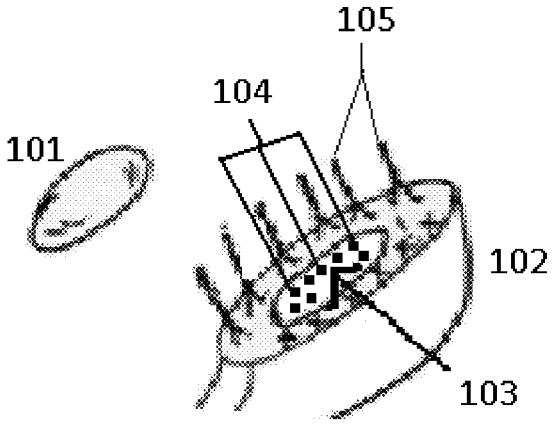
FIG. 2 is an exploded perspective view of a toothbrush head having an encapsulated bead disposed therein.

FIG. 2 shows the placement of an encapsulated bead 101 in a toothbrush head 102. The encapsulated bead 101 can fit into the cavity 103 formed in the head 102 of the toothbrush. A sponge-like cleaning member (not shown) can fit over the bristles 105. In some embodiments, protruding members 104 can be positioned in the cavity 103 to help rupture the encapsulated bead 101 when pressure is applied by the user biting down on the head 102 of the toothbrush.

Figure 3:
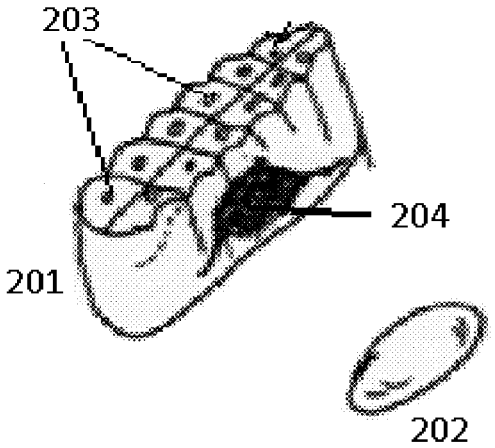
FIG. 3 is an exploded perspective view of the fabric medium comprising a sponge-like cleaning member, behind which the encapsulated bead is disposed.

FIG. 3 shows the sponge-like cleaning member 201. The encapsulated bead 202 can be positioned in the cavity formed in the toothbrush head (not shown) and behind the cavity 204 of the sponge-like cleaning member 201. The sponge-like cleaning member 201 can then be positioned over the bristles of the toothbrush (not shown) so that the bristles fit and extend through bristle holes 203.

Figure 4:
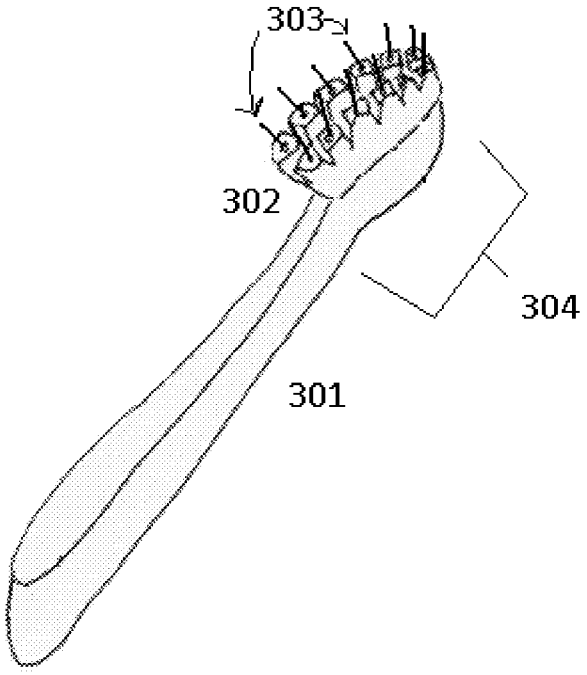
FIG. 4 is an assembled perspective view of a toothbrush having bristles on the front surface part, and having a fabric medium comprising a multi-row sponge-like cleaning member, behind which an encapsulated bead is disposed (not shown).

FIG. 4 shows an assembled toothbrush 301. The toothbrush 301 has a sponge-like cleaning member 302 positioned on the head 304 of the toothbrush 301. An encapsulated bead (not shown) can be placed inside a cavity (not shown) formed in the head 304 of the toothbrush 301, as explained above. The bristles 303 fit through the sponge-like cleaning member 302 to help clean the user's teeth. In use, the bristles 303 can reach particulate between the user's teeth, while the multiple rows of irregular cleaning surfaces of the sponge-like cleaning member 302 can clean and polish the surface of the user's teeth, to ensure a thorough tooth brushing session.

Figure 5:
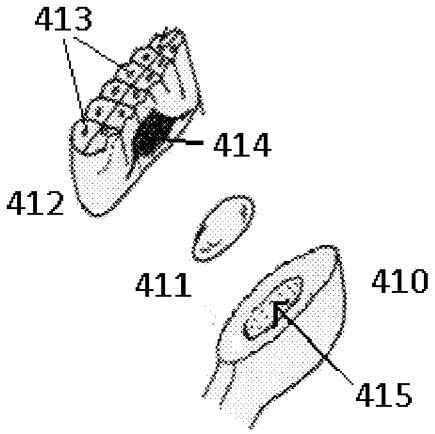
FIG. 5 is an exploded perspective view of a toothbrush with a sponge-like cleaning member and encapsulated bead.

In some embodiments, as shown in FIG. 5, bristles are not necessary. A sponge-like cleaning member 412 can be attached to the toothbrush head 410 in any fashion known in the art. Encapsulated bead 411 can fit between the cavity 414 of the sponge-like cleaning member 412 and the cavity 415 formed in the toothbrush head 410.

Figure 6:
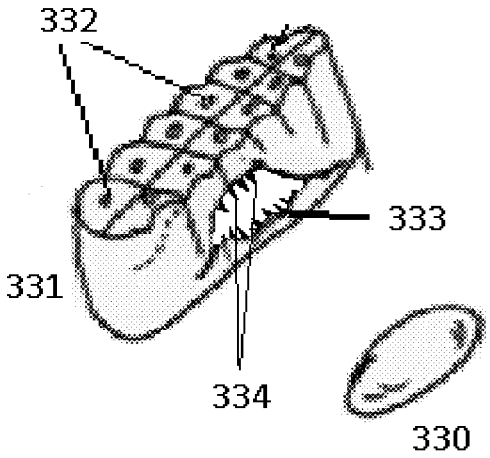
FIG. 6 is an exploded perspective view of a sponge-like cleaning member with protruding members used to rupture the encapsulated bead.

In some embodiments, as shown in FIG. 6, additional means can be provided to help rupture the encapsulated bead. The sponge-like cleaning member 331 can have a cavity 333 for holding the encapsulated bead 330. Protruding members 334 can help to rupture the encapsulated bead 330 when pressure is exerted on the sponge-like cleaning member 331. Optional pores 332 can allow for faster dissemination of the cleaning agent. In some embodiments, pores 332 can be eliminated and the cleaning agent can be allowed to seep through the sponge-like cleaning member 331 more slowly. Alternatively, protruding members 334 can be positioned in the cavity formed in the toothbrush head rather than, or in addition to, in the sponge-like cleaning member, as shown in FIG. 2.

Figure 7:
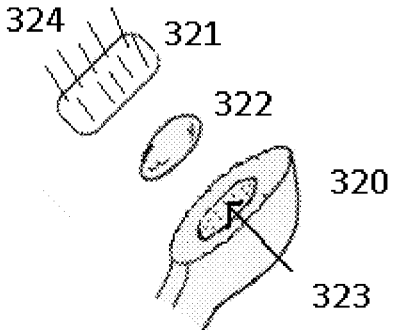
FIG. 7 is an exploded perspective view of a toothbrush with a fabric medium comprising a substantially planar surface of fabric through which a plurality of elastomeric bristles extend, and covering an encapsulated bead disposed in a cavity formed in the head of the toothbrush.

In an alternate preferred embodiment, as shown in FIG. 7, the fabric medium can be a substantially planar fabric surface positioned on the front surface part of the toothbrush head. The toothbrush head 320 can have a cavity 323 formed therein for holding the encapsulated bead 322. A fabric medium 321 can fit over the encapsulated bead 322 and can be attached to the toothbrush head 320 through any means known in the art. When the encapsulated bead 322 is ruptured by the user biting down on the toothbrush head 320, the cleaning agent contained in the encapsulated bead can seep through the fabric medium 321 and into the bristles 324. Bristles 324 can help to clean the user's teeth. In some embodiments, the bristles 324 can be positioned on the fabric medium 321 itself. In other embodiments, the bristles 324 can be positioned directly on the toothbrush head 320 and can either fit through the fabric medium 321 or can surround the fabric medium 321. When the encapsulated bead is ruptured, the fabric medium 321 can also serve to retain the shell pieces of the ruptured bead within the toothbrush head 320. This is desirable at least because the shell of the encapsulated bead may be composed of a material that is not ingestible, and therefore trapping the encapsulated bead shell pieces avoids the need to spit the pieces out.

Providing an encapsulated bead that is a crushable gel capsule allows the user to quickly and easily bite down on the toothbrush head in order to release the rapidly releasable cleaning agent, without the need for water or saliva to dissolve the capsule shell, and without the need for prolonged brushing to wear down the capsule shell. After the capsule has been ruptured, the user may proceed to brush his/her teeth normally. Additionally, the crushable, rather than dissolvable, nature of the capsule allows for improved transportability and shelf life of the toothbrush, in that the capsule resists inadvertently bursting when not in use.

Meanwhile, during the assembling operation of the fabric medium 321 with the head portion 320, it is desirable to use a separate assembling tool (not shown) which can make a plurality of coupling holes, corresponding to the elastomeric bristles 324 of the head portion 320, at the fabric medium 321 so as to easily attach the fabric medium 321 to the head portion 320.

A plurality of securing protrusions (not shown) can be further provided at the periphery of the head portion 320 so as to supplementarily prevent the fabric medium 321 from derailing outwards in the radial direction of the head portion 320. The respective securing protrusions (not shown) may be composed of a hemisphere-shaped protrusion which constitutes an upper end portion, and a stem portion which integrally connects the hemisphere-shaped protrusion with the front surface part of the head portion. Hence, such a securing protrusion structure can strengthen the bonding force between the fabric medium 321 and the front surface part of the head portion 320 with the securing force between the fabric medium 321 and the securing protrusions (not shown).

In some embodiments, the elastomeric bristles 324 of the head portion 320 may be formed in a convex pattern where the central portion is elevated and the remaining portion is lowered. Such a convex structure of the elastomeric bristles 324 can improve the contacting probability between the elastomeric bristles 324 and the teeth even when the user brushes his/her teeth in an inclined posture with respect to the ground, thereby enhancing the effects of tooth brushing.

An additional fabric medium (not shown) can be made of a microfiber material with embossing patterns and may be further attached to the rear surface part of the head portion 320. The fabric medium structure on the rear surface part of the head portion 320 allows a user to conveniently scrub his/her tongue or gums to remove bacteria or particulates. Preferably, as an exemplary embodiment, a plurality of irregular patterns (not shown) can be formed on the rear surface part of the head portion 320 in order to prevent the fabric medium (not shown) from derailing outwards. Such an irregular pattern structure serves to increase the contacting area therebetween, so as to enhance the bonding force between the fabric medium and the rear surface part of the head portion 320.

Figure 8:
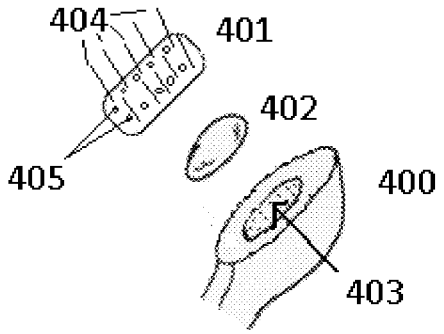
FIG. 8 is an exploded perspective view of a toothbrush with a porous fabric medium covering an encapsulated bead.

In some embodiments, as shown in FIG. 8, the fabric medium 401 can have pores 405. The encapsulated bead 402 can fit in the cavity 403 formed in the toothbrush head 400. When the encapsulated bead 402 is crushed, the cleaning agent contained therein can dissipate through the pores 405 and into the bristles 404.

In some embodiments, the fabric medium can be constructed of a microfiber material to accommodate a rapidly releasable agent, and the rapidly releasable agent can be stably attached to the fabric medium. In use, the rapidly releasable agent can be easily dissolved by the absorbing action of the fabric medium, increasing the tooth brushing effects when utilized in concert with the rapidly releasable agent contained in the encapsulated bead.

In one embodiment, the rapidly releasable agent can be attached to the gap created between the microfibers of the fabric medium and to the outer surface of the fabric medium in a dispersed form. When the rapidly releasable agent is attached to the fabric medium as such, the rapidly releasable agent can be relatively well-dissolved in the saliva or water with the help of the absorbing action of the fabric medium, compared with an agent solidified in the form of a large lump or a film, thereby improving the tooth brushing effects.

The rapidly releasable agent may be composed of at least one out of toothpaste and a bad breath remover. The toothpaste or the bad breath remover is composed of a mixture of a plurality of ingredients, in which the mixture is attached to the fabric medium and/or contained in the encapsulated bead in a stable manner. Further, the mixture is well-preserved in a particle form in the air, while being composed of an easily dissoluble form upon contacting the saliva or water.

Figure 9:
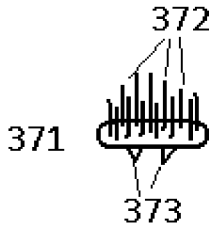
FIG. 9 is a perspective view of a fabric medium member with protrusions extending from the underside of the fabric medium to help to rupture the encapsulated bead disposed below the fabric medium when the toothbrush is assembled.

In some embodiments, as shown in FIG. 9, the fabric medium 371 can have protruding members 373 disposed on the side of the fabric medium 371 opposite the side having bristles 372. The protruding members 373 can help to rupture the encapsulated bead (not shown) when pressure is applied by the user biting down on the toothbrush head.

Figure 10:
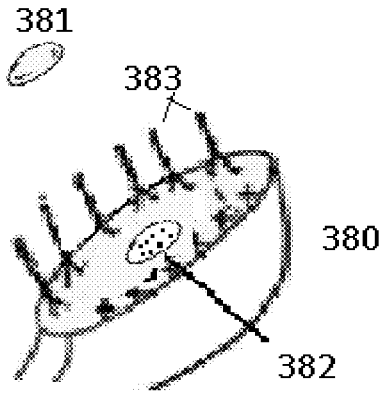
FIG. 10 is an exploded perspective view of a toothbrush head adapted for a small size encapsulated bead.

The size of the encapsulated bead is not critical to the invention. As shown in FIG. 10, the encapsulated bead 381 can be considerably smaller than the toothbrush head 380. The cavity 382 formed in the toothbrush head 380 can also be made smaller for embodiments with a smaller encapsulated bead 381. In any embodiment, bristles 383 can be secured to the front surface part of the toothbrush head 380 and can fit through a sponge-like cleaning member (not shown) to help the user clean his teeth.

Figure 11:
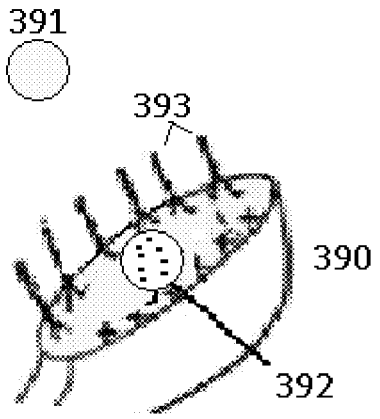
FIG. 11 is an exploded perspective view of a toothbrush head adapted for a round encapsulated bead.

Any shaped encapsulated bead is contemplated by this invention. FIG. 11 shows a circular shaped encapsulated bead 391, as opposed to an oval shaped encapsulated bead shown in the previous figures. The cavity 392 formed in the toothbrush head 390 can be made in a circular shape complementary to the encapsulated bead 391. Bristles 393 can fit through a sponge-like cleaning member (not shown) to help the user clean his teeth.

The size of the toothbrush is not critical to the invention. In some embodiments, the toothbrush can be the same size as a conventional toothbrush. In other embodiments, the toothbrush of the current invention can be larger or smaller than a conventional toothbrush. In one embodiment, the toothbrush of the present invention can be about half the size of a conventional toothbrush. This makes the toothbrush easy to carry in the pocket or the like, and then remove from the pocket, if necessary, making it convenient for use on the go. For instance, after having a meal the user can brush her teeth using the disposable toothbrush. In other embodiments, the handle portion can be provided with a folding or telescopic structure. Such a folding or telescopic structure makes it easy to carry the toothbrush.

In any embodiment, a knurling part can be formed on the outer surface of the handle portion to increase the contacting force therewith. Such a knurling part structure can prevent the handle portion from being abruptly slipped and derailed from the user's hand, when the user uses the toothbrush having a relatively shorter length as compared with a conventional toothbrush.

Figure 12:
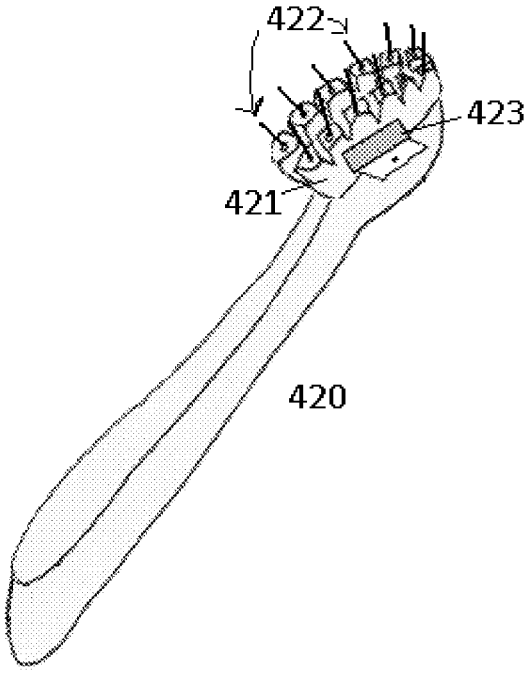
FIG. 12 is a perspective view of a toothbrush with a sponge-like cleaning member and a receiving compartment for receiving an encapsulated bead.

In some embodiments, as shown in FIG. 12, the encapsulated bead may be held in a compartment 423 in the toothbrush 420. The encapsulated bead (not shown) may be placed in the sealable compartment 423, and the compartment sealed. When the encapsulated bead (not shown) is crushed, the cleaning agent can seep through the sponge-like cleaning member 421 and into the mouth of the user. Optional bristles 422 can be used to help clean the user's mouth.

Figure 13:
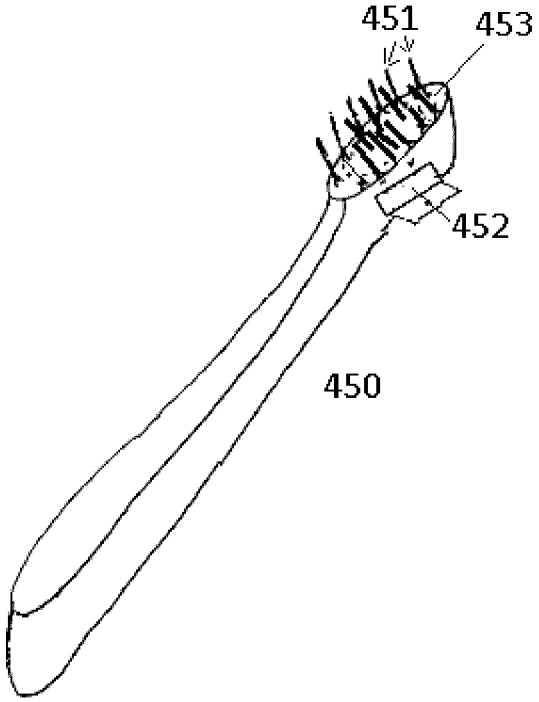
FIG. 13 is a perspective view of a toothbrush having a substantially planar fabric medium layer covering the encapsulated bead and having a receiving compartment for receiving an encapsulated bead.

FIG. 13 shows a sealable compartment 452 in an embodiment having a substantially planar fabric medium surface 453. The encapsulated bead (not shown) can be placed in the sealable compartment 452 in the toothbrush 450 and the compartment 452 can then be sealed. Bristles 453 can be positioned on the head of the toothbrush 450. When the encapsulated bead (not shown) is crushed, the cleaning agent contained in the encapsulated bead can seep into the fabric medium 453 and can be disseminated onto the teeth of the user in a controlled and even manner.

Figure 14:
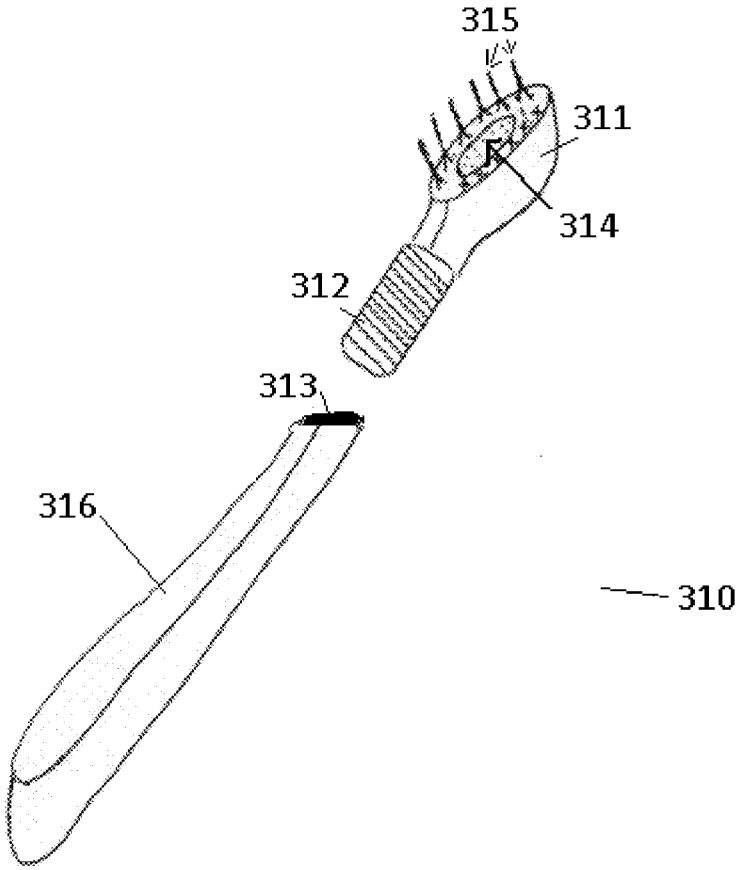
FIG. 14 is an exploded perspective view of a toothbrush having an encapsulated bead cavity in the head portion and having a screw-on head.

In some embodiments, as shown in FIG. 14, the head of the toothbrush can be detachable from the handle portion. The toothbrush 310 can have a head portion 311 and a handle portion 316. The head portion 311 can have a screwing member 312 that can engage with ridges 313 disposed on the interior of the handle portion 316. The encapsulated bead (not shown) can fit into the cavity 314 formed in the head portion 311. The encapsulated bead can be covered by a fabric medium (not shown) that can comprise either a substantially planar fabric portion or a sponge-like cleaning member. Bristles 315 can also be positioned on the head portion 311. In other embodiments, the screw portion 312 can be on the handle portion 316 of the toothbrush 310 and the ridges 313 for receiving the screw portion 312 can be positioned on the head portion 311 of the toothbrush 310.

Figure 15:
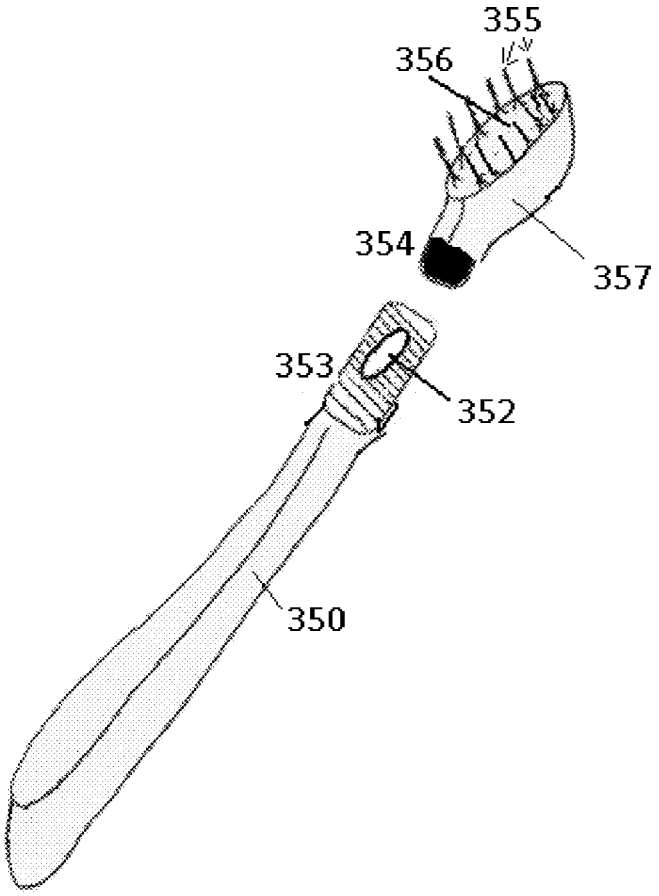
FIG. 15 is an exploded perspective view of a toothbrush having an encapsulated bead cavity in the handle of the toothbrush and having a screw-on head.

In other embodiments of the detachable toothbrush, as shown in FIG. 15, the cavity 352 for holding the encapsulated bead (not shown) can be positioned on the screw portion 353 itself. When the screw portion 353 located on the handle 350 of the toothbrush is screwed into the receiving ridges 354 located inside the head portion 357 of the toothbrush, the cavity 352 will be located near the center of the head portion 357. The center of the head portion 357 can be made out of a fabric medium 356 so that when the encapsulated bead is broken, the cleaning agent contained in the encapsulated bead can seep into the fabric medium 356. Bristles 355 can also be positioned on the toothbrush.

Figure 16:
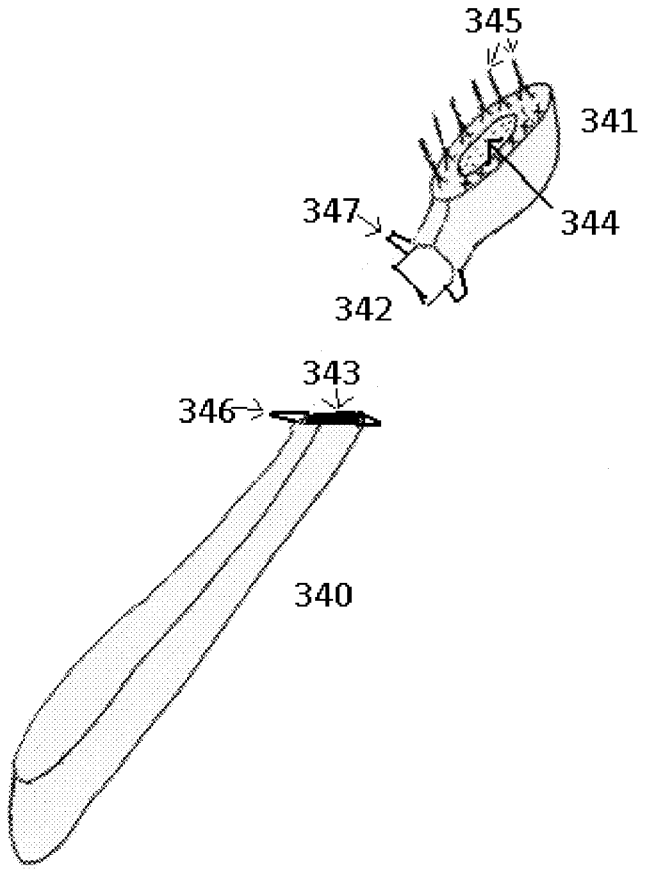
FIG. 16 is an exploded perspective view of a toothbrush having an encapsulated bead cavity in the head portion and having a snap-on head.

Other connection means between the handle portion and the head portion are contemplated by this invention. FIG. 16 shows a snap-on connection. The handle portion 340 of the toothbrush can have a receiving portion 343. The head portion 341 of the toothbrush can have an engagement portion 342 that can be inserted into the receiving portion 343. When this is done, flanges 347 can engage with engagement member 346 to hold the handle portion 340 and head portion 341 of the toothbrush together. The head portion 341 can have a cavity 344 for holding the encapsulated bead (not shown) and bristles 345 for cleaning the teeth of the user.

Figure 17:
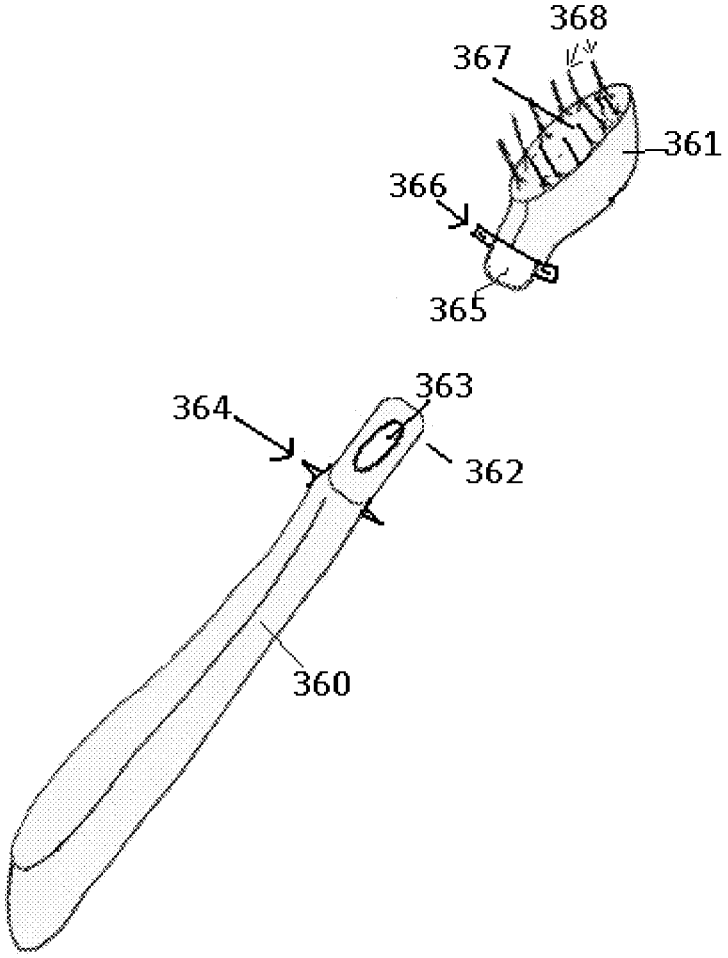
FIG. 17 is an exploded perspective view of a toothbrush having an encapsulated bead cavity in the handle of the toothbrush and having a snap-on head.

As shown in FIG. 17, the cavity 363 for holding the encapsulated bead (not shown) can be positioned on the engagement portion 362 itself. When the engagement portion 362 located on the handle 360 of the toothbrush is inserted into the receiving portion 365 located on the head 361 of the toothbrush, the cavity 363 will be located near the center of the head portion 361. Flanges 364 can engage with engagement members 366 to ensure the proper alignment of the cavity 363 within the toothbrush head 361. The center of the head portion 361 can comprise a fabric medium 367 so that when the encapsulated bead is broken, the cleaning agent contained in the encapsulated bead can seep into the fabric medium 367. Bristles 368 can also be included on the toothbrush.

Figure 18:
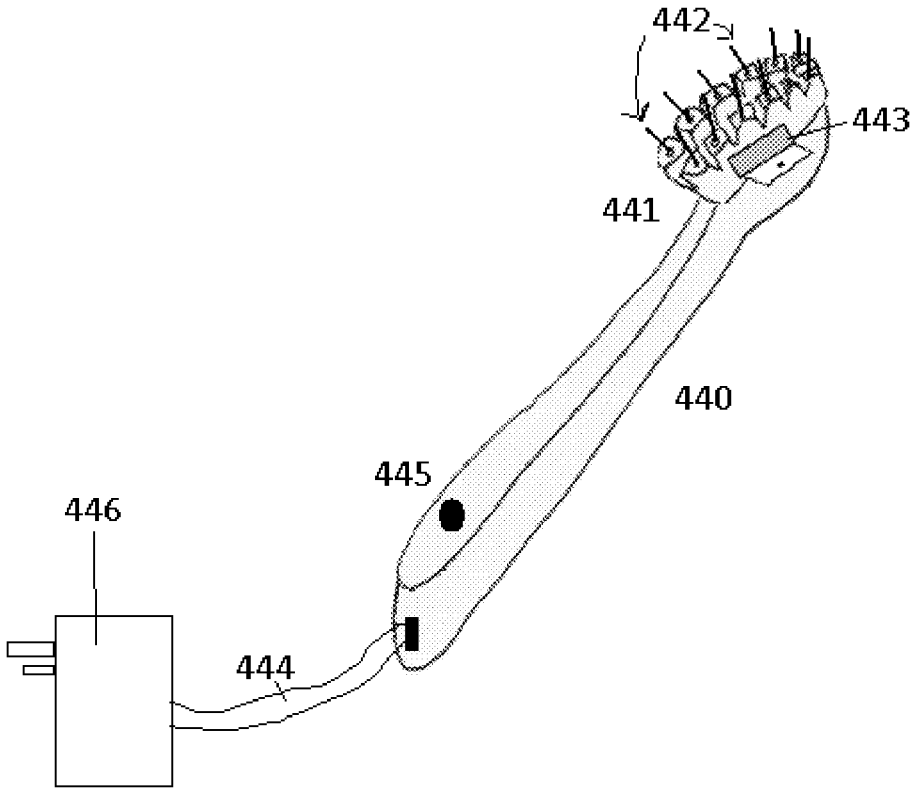
FIG. 18 is a perspective view of an electric toothbrush configured to receive an encapsulated bead.

In some embodiments, as shown in FIG. 18, the toothbrush 440 may be an electric toothbrush. The toothbrush 440 can be attached to a plug 446 by cord 444. The toothbrush 440 may include a sponge-like cleaning member 441 on the head and optionally bristles 442. The toothbrush 440 may also include an optional receiving compartment 443 for receiving the encapsulated bead (not shown). When the user turns on the toothbrush 440 by switch 445, the sponge-like cleaning member 441 and/or bristles 442 may vibrate to help clean the teeth of the user. In some embodiments, the vibrating motion may also automatically break the encapsulated bead (not shown).

Figure 19:
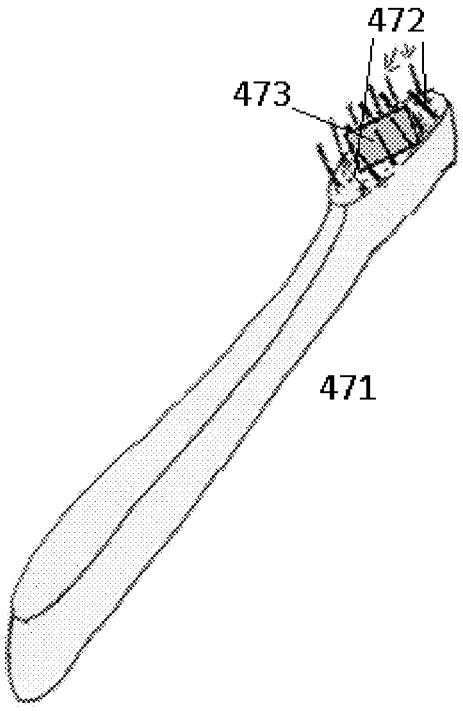
FIG. 19 is a perspective view of a toothbrush having a folded fabric medium inserted into the bristles disposed on the front surface part of the head portion of the toothbrush.

FIG. 19 shows an embodiment wherein a fabric insert 473 is inserted in between the bristles 472 of the toothbrush 471. The fabric insert can have a rapidly releasable cleaning agent disposed thereon. When the user uses the toothbrush 471, the fabric insert 473 positioned between the bristles 472 can release the cleaning agent and freshen the user's mouth. The fabric insert 473 containing the rapidly releasable cleaning agent can be either wet or dry.

Although preferred embodiments of the present invention have been described for illustrative purposes, those skilled in the art will appreciate that various modifications, additions and substitutions are possible, without departing from the scope and spirit of the invention as disclosed in the accompanying claims.

I claim:

1. A disposable toothbrush comprising:

a handle portion;

a head portion connected with the handle portion and provided with a plurality of elastomeric bristles on a front surface part of the head portion;

a fabric medium attached to the front surface part of the head portion while exposing an upper end of the elastomeric bristles;

an encapsulated bead containing at least one kind of a rapidly releasable agent disposed in a cavity formed in the head portion behind the fabric medium; wherein the encapsulated bead comprises a crushable gel capsule; and wherein the cavity formed in the head portion of the toothbrush further comprises protrusions disposed adjacent to the crushable gel capsule such that the protrusions rupture the crushable gel capsule when the crushable gel capsule is subjected to pressure.

2. The disposable toothbrush of claim 1, wherein the fabric medium comprises a sponge-like cleaning member, wherein the plurality of elastomeric bristles extends through the sponge-like cleaning member.

3. The disposable toothbrush of claim 2, wherein the sponge-like cleaning member comprises multiple rows of irregular cleaning surfaces.

4. The disposable toothbrush of claim 1, wherein the fabric medium comprises a substantially planar surface of fabric though which the plurality of elastomeric bristles extends.

5. The disposable toothbrush as recited in claim 1, wherein the fabric medium is made of a microfiber material provided with at least one kind of a rapidly releasable agent.

6. The disposable toothbrush of claim 5, wherein the rapidly releasable agent is attached to a gap between the microfibers of the fabric medium and an outer surface of the fabric medium.

7. The disposable toothbrush as recited in claim 5, wherein the rapidly releasable agent is at least one out of toothpaste and a bad breath remover.

8. The disposable toothbrush as recited in claim 1, further comprising a plurality of securing protrusions at the periphery of the head portion so as to prevent the fabric medium from derailing outwards in a radial direction of the head portion.

9. The disposable toothbrush as recited in claim 8, wherein the plurality of securing protrusions are composed of a hemisphere-shaped protrusion constituting an upper end portion, and a stem portion integrally connecting the hemisphere-shaped protrusion with the front surface part of the head portion.

10. The disposable toothbrush as recited in claim 1, further comprising a fabric medium made of a microfiber material with embossing patterns on a rear surface part of the head portion.

11. The disposable toothbrush as recited in claim 10, wherein a plurality of irregular patterns are provided on the rear surface part of the head portion to prevent the fabric medium from derailing outwards.

12. The disposable toothbrush as recited in claim 1, wherein the handle portion further includes an inter-dental brush secured to a rear end of the handle portion, and a protective cap detachably coupled to the rear end of the handle portion to protect the inter-dental brush.

13. The disposable toothbrush as recited in claim 12, wherein the protective cap is made from at least a partially transparent material.

14. The disposable toothbrush as recited in claim 1, wherein a knurling part is further provided on an outer surface of the handle portion to increase the contacting force therewith.

15. The disposable toothbrush as recited in claim 1, wherein the elastomeric bristles of the head portion are formed in a convex pattern such that the elastomeric bristles have a central portion elevated relative to a remaining portion.

16. The disposable toothbrush as recited in claim 1, wherein the handle portion is provided with a folding or telescopic structure.

17. A disposable toothbrush comprising:

a handle portion;

a head portion connected with the handle portion;

a fabric medium comprising a sponge-like cleaning member attached to a front surface part of the head portion;

an encapsulated bead containing at least one kind of a rapidly releasable agent disposed in a cavity formed in the head portion behind the fabric medium; wherein the encapsulated bead comprises a crushable gel capsule; and wherein the cavity formed in the head portion of the toothbrush further comprises protrusions disposed adjacent to the crushable gel capsule such that the protrusions rupture the crushable gel capsule when the crushable gel capsule is subjected to pressure.

18. A disposable toothbrush comprising:

a handle portion;

a head portion connected with the handle portion and provided with a plurality of elastomeric bristles on a front surface part of the head portion;

a fabric medium which may be inserted between the plurality of elastomeric bristles, wherein the fabric medium is made of a microfiber material provided with at least one kind of a rapidly releasable agent; and a plurality of securing protrusions at the periphery of the head portion so as to prevent the fabric medium from derailing outwards in a radial direction of the head portion.

* * * * *